United States Patent [19]

Mizuno et al.

[11] Patent Number: 5,044,353

[45] Date of Patent: Sep. 3, 1991

[54] LIQUID FUEL COMBUSTION TYPE INFRARED RAY IRRADIATING APPARATUS

[75] Inventors: Akira Mizuno; Hiroshi Komai; Toshio Ina; Tadao Suzuki, all of Shizuoka, Japan

[73] Assignee: Shizuoka Seiki Co., Ltd., Shizuoka, Japan

[21] Appl. No.: 543,155

[22] Filed: Jun. 25, 1990

[30] Foreign Application Priority Data

Jun. 28, 1989 [JP] Japan ..... 1-166162

[51] Int. Cl.[5] ..... F24C 3/00

[52] U.S. Cl. ..... 126/91 A; 126/91 R; 126/92 B; 431/328

[58] Field of Search ..... 126/91 A, 92 B, 91 R, 126/92 AC; 431/328

[56] References Cited

U.S. PATENT DOCUMENTS 2,946,510 7/1960 Galuin ..... 126/91 A X
4,140,100 2/1979 Ishihara ..... 431/328 X
4,676,737 6/1987 Suzuki et al. ..... 431/328
4,727,854 3/1988 Johnson ..... 431/328

FOREIGN PATENT DOCUMENTS 1101065 9/1955 France ..... 126/91 A
58-18111 4/1983 Japan .

*Primary Examiner*—Larry Jones
*Attorney, Agent, or Firm*—Flynn, Thiel, Boutell & Tanis

[57] ABSTRACT

A liquid fuel combustion type infrared ray irradiating apparatus includes a base having a generally rectangular-shaped framework, each corner of which is provided with a wheel, a fuel tank fixed to the base, and a pump disposed on the base and adapted to pump fuel from the fuel tank. A combustion chamber is connected to a burner which receives fuel from the pump for combustion. An irradiation pipe is connected to the combustion chamber for guiding combustion gas from the combustion chamber into an upper chimney, receiving heat from the combustion gas, and irradiating infrared rays. Reflecting plates are disposed to forwardly reflect rearwardly directed radiant heat which has been radiated from the irradiation pipe.

12 Claims, 5 Drawing Sheets

PRIOR ART

LIQUID FUEL COMBUSTION TYPE INFRARED RAY IRRADIATING APPARATUS

FIELD OF THE INVENTION

This invention relates to a liquid fuel combustion type infrared ray irradiating apparatus (i.e. a portable heating apparatus) of the type in which liquid fuel such as kerosene is combusted and infrared rays are irradiated from the outer surface of an irradiation pipe for guiding combustion gas resulted from the combustion of liquid fuel.

BACKGROUND OF THE INVENTION

The prior art of this type is disclosed in Japanese Utility Model Publication No. Sho 58-18111. This conventional device comprises, as shown in FIGS. 5(*a*) and 5(*b*), a base 1 having wheels 11; a burner 12, a combustion chamber 13 and an irradiation pipe 14 which are disposed on a front part of said base 1; and a blower 15 and a fuel tank 16 which are disposed on a rear part thereof, said combustion chamber 13 being formed by double inner and outer cylindrical structures. The air rate to be supplied into said inner and outer cylindrical structures can be regulated. The heat irradiating portion 2 is provided with a guard 4 stretched across its front surface. Furthermore, the heat irradiating portion 2 is provided with a control disk 3 projecting sidewards therefrom.

In this conventional device, the heat irradiating portion 2 including the irradiation pipe 14, and the fuel tank 16 are disposed respectively on front and rear parts of the upper surface of the base 1. Accordingly, the front-to-back width of the device is large and the center of gravity of the whole device is high.

Also, because the prior art device is constructed such that the air rate to be supplied to the combustion chamber is regulated, the construction is complicated and the operation is troublesome.

Furthermore, when the device is viewed as a whole, the fuel tank 16 and the control disk 3 project therefrom. Accordingly, the outer appearance and design thereof are not neat or streamlined, the device is bulky when assembled, and transportation is not efficient.

The invention of the present application has been accomplished in an attempt to obviate the above-mentioned inconveniences inherent in the conventional liquid fuel combustion type infrared ray irradiating apparatus.

Therefore, objects of the present invention include providing: (1) an apparatus of the aforementioned type in which the front-to-back width is small and the center of gravity is low; (2) an apparatus of the aforementioned type in which the supplying rate of air is not required to be regulated; (3) an apparatus of the aforementioned type in which cooling efficiency of the apparatus itself is enhanced; (4) an apparatus of the aforementioned type which is light in weight and yet rigid in structure; and (5) an apparatus of the aforementioned type having a reflecting plate which is designed so as to be easy to mount.

The invention of the present application is characterized in providing means as listed hereunder in order to achieve the above objects.

As for the first object, a fuel tank is fixedly suspended astride parallel members which form long sides of a base formed in a generally parallel tetragon, the base being provided, on a lower surface thereof, with wheels.

As for the second object, there is provided an outer jacket surrounding a combustion chamber, the combustion chamber being linearly connected to a burner, and the outer jacket being provided with a plurality of openings.

As for the third object, a cooling air flow passage is formed by a reflecting bottom plate covering an upper surface of the base, reflecting plates disposed behind an irradiation pipe, and a back cover covering the back of a heat irradiating portion of the apparatus.

As for the fourth object, there is provided a reinforcement member, the ends of which are fixed to rearward parts of right and left side plates on the heat irradiating portion, an intermediate portion other than the fixed ends of said reinforcement member being bowed slightly backward relative to the fixed ends and the side plates.

As for the fifth object, there are provided a plurality of reflecting plates, each of which is fixed for support at each end thereof to one of a pair of right and left reflecting side plates in said heat irradiating portion, and each of which is formed with a bent portion along a lower edge thereof.

The invention of the present application having such characteristic construction as mentioned above functions as follows:

The fuel tank is disposed beneath the heat irradiating portion, thus reducing the front-to-back width of the apparatus and the required installation area. In addition, because the fuel tank is disposed beneath the heat irradiating portion, the center of gravity becomes lower than that of the conventional apparatus. Moreover, the center of gravity becomes even lower when additional fuel is supplied, and therefore the apparatus is less susceptible to tipping over.

The combustion chamber which becomes the highest in temperature by combustion is surrounded with an outer jacket and a plurality of openings are formed in the periphery of the outer jacket. Accordingly, a large quantity of local radiation of infrared rays coming from the high temperature and red-hot combustion chamber is absorbed by the outer jacket, and mild irradiation of infrared rays is performed from the outer surface of the outer jacket. In this way, irradiation of the infrared rays is equalized or averaged at each part of the entire surface of the heat radiation chamber. Also, the red-hot state of the combustion chamber can be seen through the openings formed in the periphery of the outer jacket, and the operation of the apparatus can thus be visually confirmed from a distance.

Cooling air is passed from beneath the reflecting bottom plate covering the upper surface of the base toward the back side of the reflecting plates of the heat irradiating portion, and the cooling air is drawn in from a low position where the temperature is lowest. Accordingly, effective cooling is performed, and high back cover temperatures are avoided.

The reinforcement member is stretched between the right and left side plates of the heat irradiating portion, and accordingly, the strength of the heat irradiating portion is increased. As a result, the thickness of the structural plates used can be reduced to realize a light weight apparatus. In addition, as the reinforcement member is bowed slightly backwardly, a predetermined space, even when the apparatus is installed along a wall surface, is naturally maintained between the wall surface and the apparatus and no accumulation of heat occurs. Moreover, the reinforcement member also serves as a handle when the apparatus is transferred to a new location.

Because the reflecting plates are simply fixed to the right and left reflecting side plates, the mounting operation is easy. Also, the bent portion formed at the lower edge of each reflecting plate reduces noises generated due to vibration during operation of the apparatus.

BRIEF DESCRIPTION OF THE DRAWINGS

A preferred embodiment of the invention will be disclosed below with reference to the drawings, in which:

FIG. 4(*b*) is a partly enlarged view thereof;

FIG. 5(*b*) is a side view thereof.

DETAILED DESCRIPTION

Figure 1:
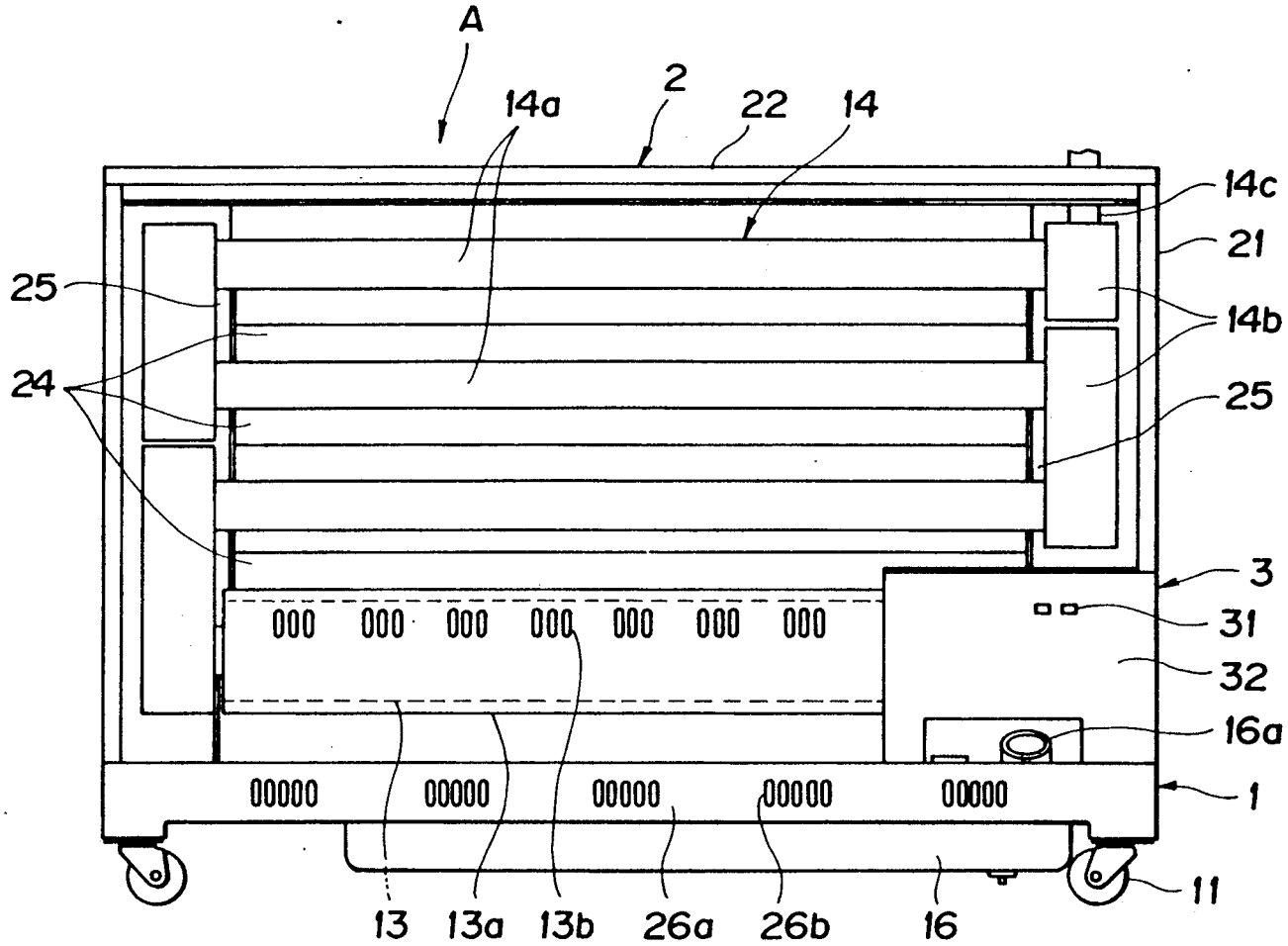
FIG. 1 shows the preferred embodiment of the invention of this application and is a front view with a front guard removed therefrom.
Figure 2:
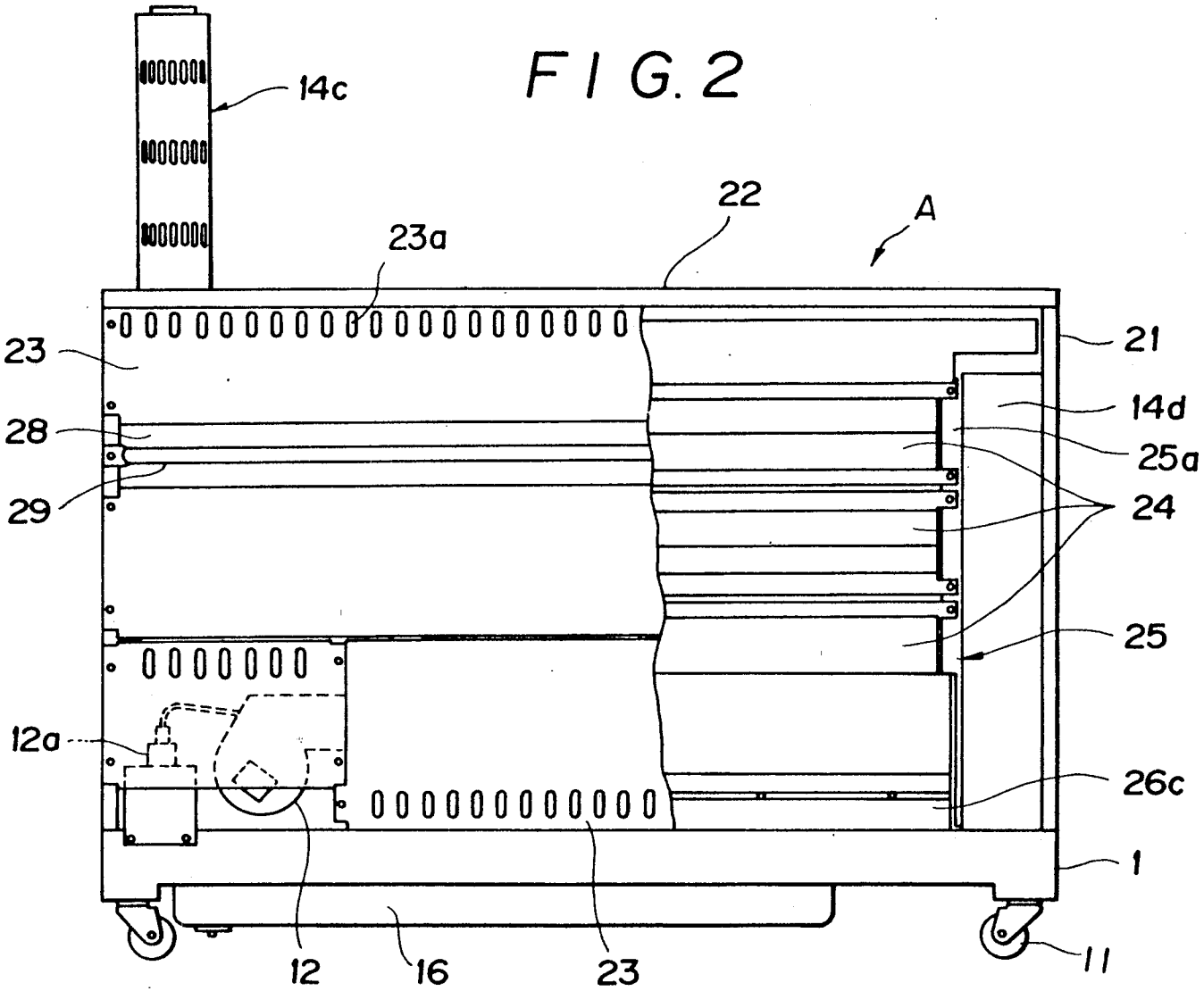
FIG. 2 is a rear view thereof with a back cover thereof partly cut away.

The invention of the present application will be described by way of a preferred embodiment with reference to FIGS. 1 through 4.

In the drawings, an infrared ray irradiating apparatus A comprises a base 1, each of four corners of which is provided with a wheel 11, a burner 12 mounted on the base 1, a combustion chamber 13 linearly connected to the burner 12 on the base 1, and a heat irradiating portion 2 including a radiation pipe 14 for guiding combustion gas generated in the combustion chamber 13.

Figure 3A:
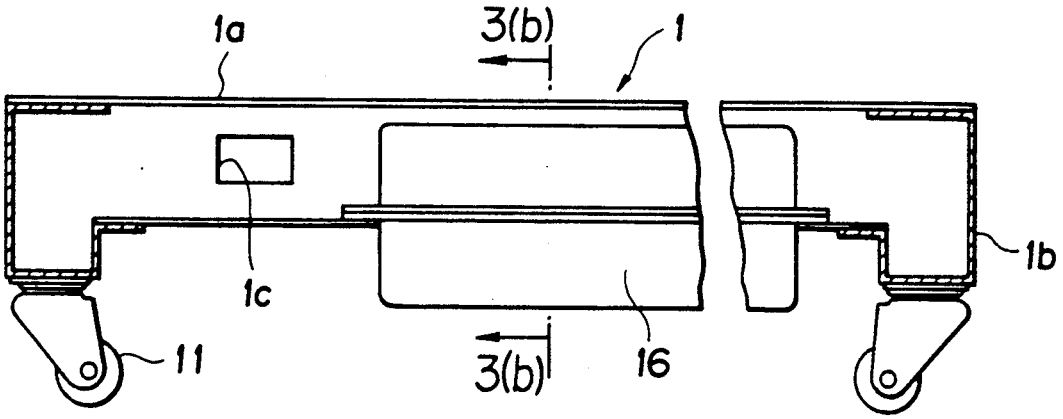
FIGS. 3(*a*)-(*c*) show a base thereof, with FIG. 3(*a*) being a broken partly sectional view taken on line 3(*a*)—3(*a*) of FIG. 3(*b*), FIG. 3(*b*) being a partly sectional view taken on line 3(*b*)—3(*b*) of FIG. 3(*a*), and FIG. 3(c) being a partly broken plan view.
Figure 3B:
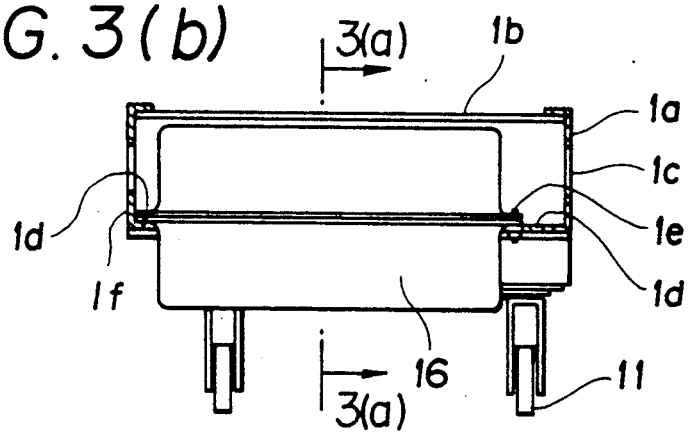
Figure 3C:
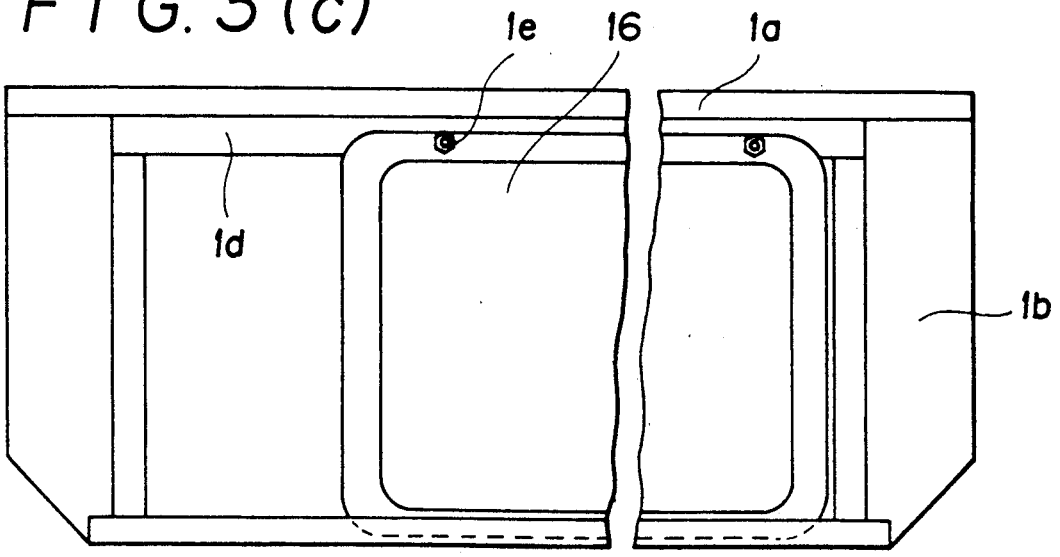

The base 1, as shown in FIGS. 3(*a*)-3(*c*), comprises a pair of parallel long side members 1*a* , a pair of short side members 1*b*, perpendicular to said parallel long side members 1*a* , and the wheels 11, each on a lower surface of each corner. Each of the long side members 1*a* is provided with punched holes 1*c*. Also, the parallel long side members 1*a* as formed in a generally U-shape in cross section, and a fuel tank 16 is placed thereon astride a pair of horizontal legs 1*d* at a lower side thereof. One side of the fuel tank 16 is abutted against a central bight 1*g* of one long side member 1*a* , and the other side is fixed to the leg 1*d* of the other member 1*a* by machine screws 1*e*.

The burner 12 is preferably a gun type burner, and fuel oil pumped up from the fuel tank 16 is sprayed into the combustion chamber 13 for combustion. The combustion chamber 13 is surrounded by an outer jacket 13*a* (FIG. 4(*a*)) having a plurality of spaced openings 13*b* (FIG. 1) formed in its periphery. The irradiation pipe 14 comprises a combination of straight pipes 14*a* and connecting pipes 14*b* connected to an upper chimney 14*c*.

Figure 4:
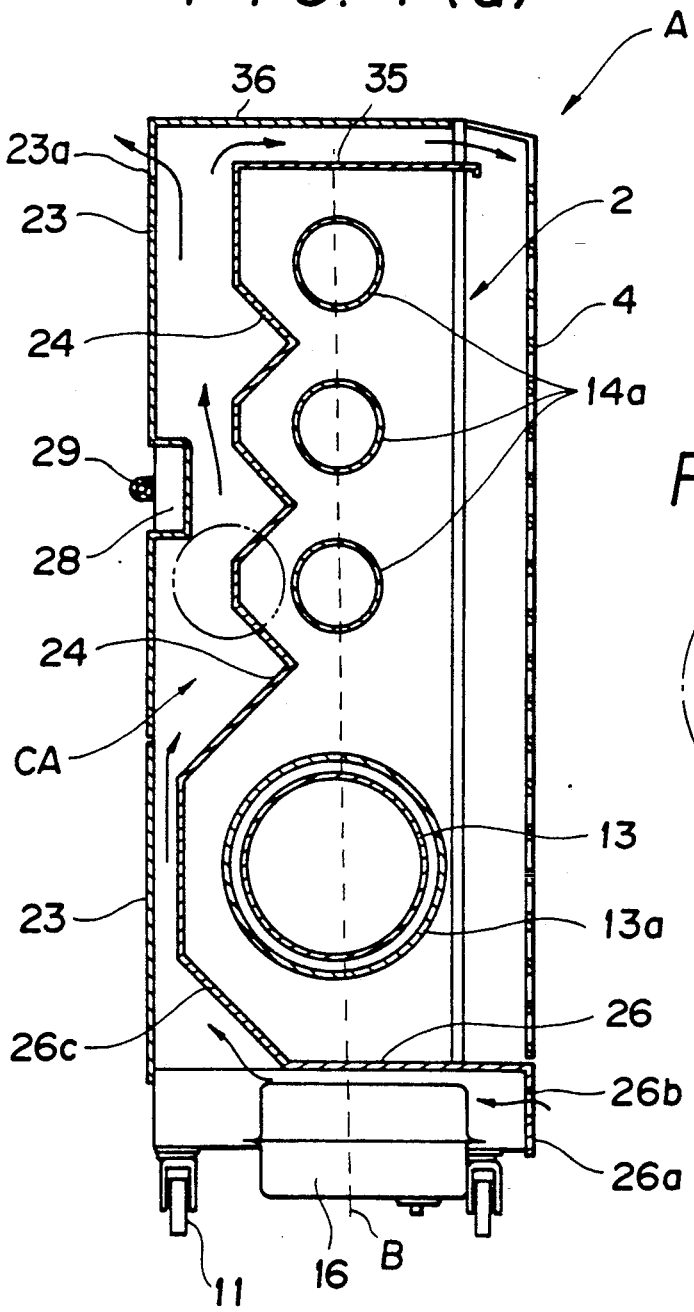
FIG. 4(*a*) is a vertical sectional view of the preferred embodiment.
Figure 4:
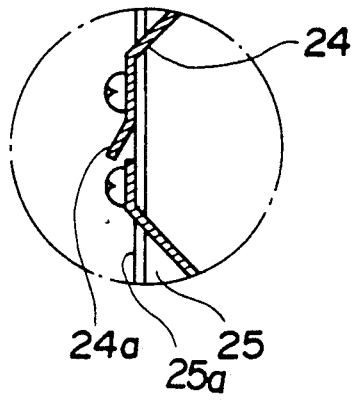
Figure 5:
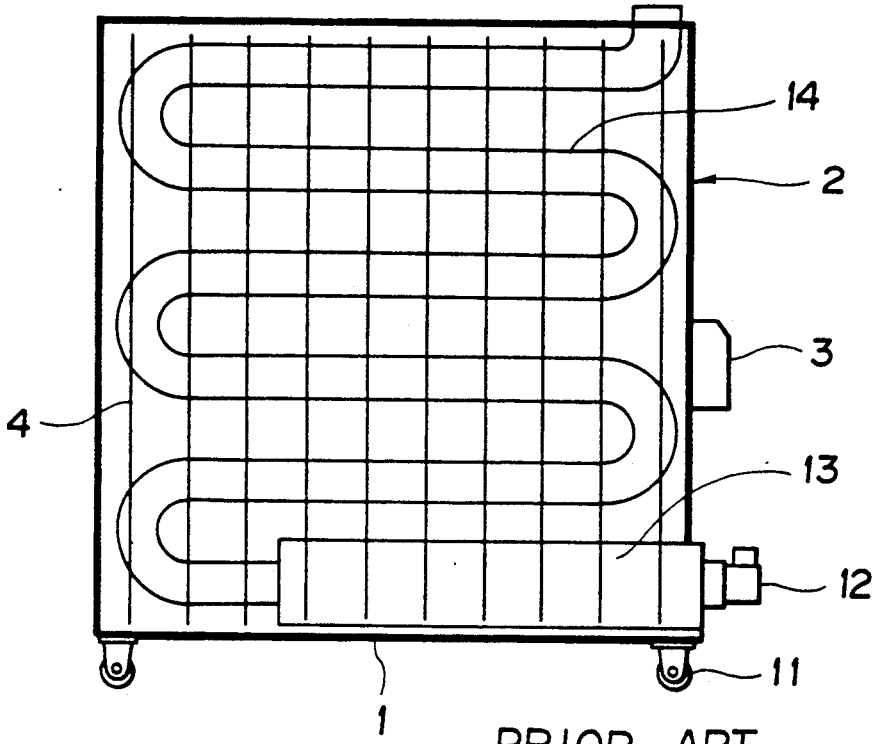
FIG. 5(*a*) is a front view of a prior art device.
Figure 5:
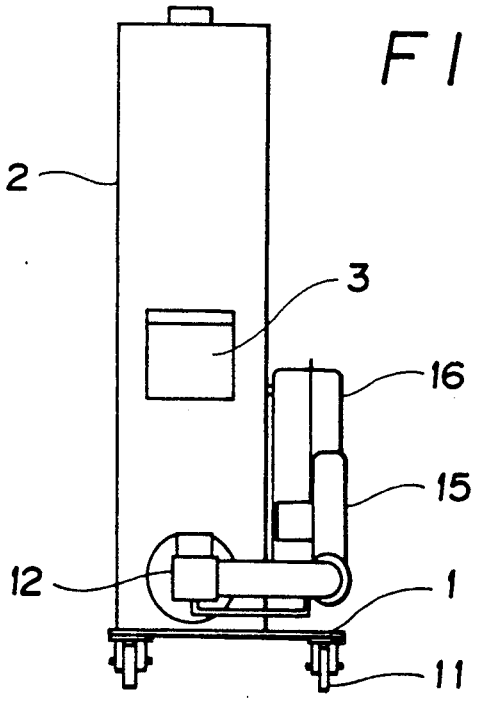
PRIOR ART FIG. 5 (b)

As shown in FIG. 4(*a*), the fuel tank 16 lies below the combustion chamber 13 and irradiation pipe 14, all of these components intersecting a common vertical plane B.

At the rear of the heat irradiating portion 2, there are disposed upper and lower back covers 23 in a vertical plane, and surrounded with right and left side plates 21, a top plate 22 and the base 1. A guard 4 (FIG. 4(*a*)) is disposed on the front of the irradiating portion 2, thereby to form a rectangular parallelepiped space or clearance which is thin in front-to-back dimension. The combustion chamber 13 and the irradiation pipe 14 are housed in this clearance, and main reflecting plates 24, adapted to reflect infrared rays frontwardly (rightwardly in FIG. 4(*a*)), are disposed between these component elements and the back covers 23. These reflecting plates 24 are bent or reversely angled in section as shown in FIG. 4 in order to reflect infrared rays irradiated from the irradiation pipe 14 in the forward direction as much as possible. Moreover, the reflecting plates 24 are fixed at each end to sidewardly extending flanges 25*a* of reflecting side plates 25 (FIGS. 2 and 4(*b*)), which side plates are in turn fixed to a supporting plate 14*d* which also supports the connecting pipe 14*b*. An intermediate portion of each reflecting plate 24 is not fixed at all. Furthermore, the lower edges of the reflecting plates 24 are slightly bent to form a bent portion 24*a* as shown in FIG. 4(*a*).

Furthermore, on the upper surface of the base 1, there is provided a reflecting bottom plate 26 (FIG. 4(*a*)) in order to reflect irradiating heat from the combustion chamber 13 and its outer jacket 13*a*. This reflecting bottom plate 26 is provided with a front cover 26*a* for covering the front surface of the base 1, and this cover is further provided with openings 26*b*. The reflecting bottom plate 26 is bent to form an upper rearwardly inclined portion 26*c* which overlies a rear portion of the base 1 and is connected to the lowest reflecting plate 24. Referring to FIG. 4(*a*), a continuous cooling air passage CA is formed by the openings 26*b*, the punched holes 1*c* in the base 1, an inlet portion including a space between the fuel tank 16 and the reflecting bottom plate 26, a main portion including spaces between the back covers 23 and the reflecting plates 24, and openings 23*a* in the upper back cover 23.

The reflecting side plates 25 are arranged to be spaced inwardly from the right and left side plates 21, so that draft air current can also rise through the space therebetween.

A top reflecting plate 35 is provided above the highest reflecting plate 24, and an auxiliary air passage is defined between the plate 35 and the top 36 of the apparatus A, this auxiliary passage permitting air flow between the openings 23*a* in the rear cover 23 and the grill-type front guard 4.

The numeral 29 denotes a reinforcement member stretched between the right and left side plates 21 in such a fashion as to be opposed to a rearwardly opening recess portion 28 formed by bending the upper back cover 23 on the back of the heat irradiating portion 2. The reinforcement member 29 is fixed at both ends thereof adjacent the side plates 21, and the intermediate portion thereof bows slightly rearwardly (i.e. outwardly) of the back cover 23, as shown in FIG. 4(*a*).

Referring to FIG. 1, 16*a* denotes a fuel feeding port of the fuel tank 16, and 31 is a switch disposed on an operating panel 32 of a control portion 3.

Next, the operation will be described.

Fuel is charged into the fuel tank 16 from the fuel feeding port 16*a*. Then, the switch 31 of the operating panel 32 of the control portion 3 is switched on to start operation. As a result, an electromagnetic pump 12*a* is actuated to pump fuel from the fuel tank 16 and feed it to the burner 12. The burner 12 sprays the fuel toward the interior of the combustion chamber 13 for combustion. Combustion gas is generated and discharged outside from the chimney 14*c* via the straight pipes 14*a* and the connecting pipes 14*b*. In the meantime, as heat energy generated by combustion is transferred to the irradiation pipe 14, the irradiation pipe 14 irradiates infrared rays, particularly a large quantity of far infrared rays from the outer surface of the irradiation pipe 14. This irradiation occurs along the entire periphery of the irradiation pipe 14. Infrared rays irradiated backward are reflected forwardly by the reflecting plates 24, and the infrared rays are effectively irradiated toward the front surface of the apparatus A.

Also, because the heat energy generated in the combustion chamber 13 is huge, it becomes excessively red hot. However, the outer surface temperature of the outwardly spaced outer jacket 13*a* remains at 600° C. or less, and infrared radiation irradiated therefrom reduces differences with respect to other parts of irradiation pipe 14, thus realizing regular radiation from each part as a whole. In addition, by virtue of the provision of the openings 13*b* in the outer shell 13*a*, the red hot state of the combustion chamber 13, which is spaced radially inwardly from the outer jacket 13*a*, can be visually recognized, and the operating state can thus be confirmed from a distance. Also, by lowering the temperature of the combustion chamber 13 through direct irradiation of the infrared rays from the openings 13*b*, damage caused by an excessive increase in temperature can be prevented.

Furthermore, although the temperature increase of the reflecting plates 24 is unavoidable by the above-mentioned operation, the temperature increase of the back covers 23 of the heat irradiating portion 2 is very little because cool air from near the floor surface passes, by draft effect, through the air passage CA.

Because the reinforcement member 29 is bowed slightly backward, even if the apparatus A is installed along a wall surface, for example, a gap is necessarily maintained between the apparatus A and the wall surface. Accordingly, heat is not accumulated on the wall surface even if the apparatus is operated for a long time. The reinforcement member 29 serves as a handle when the apparatus is to be transferred to a new location, and it also serves as means for reinforcing the heat irradiating portion. Accordingly, the right and left side plates 21 can be formed of thin plate material which is helpful for making the apparatus light in weight. It is impossible to change the construction of the reinforcement member 29 in accordance with the spirit of the invention. For example, the intermediate portion other than the fixed end portions can be only slightly bowed or the bowed portion can be more exaggerated to enjoy variations of design.

Also, since the reflecting plates 24 are fixed only at both ends thereof and the intermediate portion is merely bent into the bent portion 24*a*, machining and assembling are easy. In addition, noise generated by vibration during operation is reduced. This bent portion 24*a* may also be similarly formed on an upper end portion of the reflecting plates 24.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A liquid fuel combustion type infrared ray irradiating apparatus, comprising:

a base formed in a generally tetragon-shaped framework having opposed pairs of approximately parallel members which extend generally horizontally, each corner of said framework being provided with a wheel;

a fuel tank fixedly suspended astride one said opposed pair of parallel members which form long horizontally extending opposed sides of said base;

a pump disposed on said base and adapted to pump fuel from said fuel tank;

a burner for receiving fuel from said pump and combusting same;

a combustion chamber connected to said burner;

an irradiation pipe connected to said combustion chamber for guiding combustion gas from said combustion chamber into an upper chimney, receiving heat from said combustion gas, and irradiating infrared rays; and a heat irradiating portion for supporting said irradiation pipe, and having a main reflecting plate upstanding from said base for forwardly reflecting rearwardly directed radiant heat radiated from said irradiation pipe.

2. A liquid fuel combustion type infrared ray irradiating apparatus as claimed in claim 1, including a continuous cooling air passage defined by (1) said main reflecting plate, (2) a reflecting bottom plate supported on the base and spaced above an upper surface of said fuel tank, and (3) a back cover of said heat irradiating portion upstanding from said base and spaced rearwardly from said main reflecting plate, said cooling air passage having an inlet portion and a main portion, said inlet portion being defined between said reflecting bottom plate and said upper surface of said fuel tank, said main portion being defined between said main reflecting plate and said back cover and extending upwardly therebetween, said main and inlet portions being disposed in openly adjoining and freely communicating relationship with each other.

3. An apparatus according to claim 2, wherein one of said members of said base has openings extending therethrough adjacent said inlet portion to permit entry of cooling air into said cooling air passage, said back cover having further openings which extend therethrough adjacent an upper edge thereof in open communication with an upper end of said main portion to permit cooling air to exit from said cooling air passage.

4. An apparatus according to claim 3, wherein said heat irradiating portion includes a grid-like protective front grill disposed in generally parallel opposed relationship to said back cover, said heat irradiating portion including means defining an auxiliary passage for permitting air flow between said front grill and said further openings of said back cover, and said auxiliary passage being in open communication with said upper end of said main portion of said cooling passage.

5. The apparatus according to claim 1, wherein said fuel tank, said combustion chamber, and said irradiation pipe each intersect a common vertical plane, said fuel tank being positioned, in its entirety, below said chamber and said pipe.

6. An apparatus according to claim 1, wherein said fuel tank extends horizontally between said one pair of parallel members and is fixedly secured to one of said parallel members, said fuel tank including a portion which vertically overlies and is vertically supported on the other of said parallel members of said one pair, and said fuel tank being located, in its entirety, interiorly of said tetragon-shaped framework.

7. An apparatus according to claim 6, wherein said portion of said fuel tank rests on said other parallel member and is free of fastening devices.

8. The apparatus according to claim 7, wherein said fuel tank, said combustion chamber, and said irradiation pipe each intersect a common vertical plane, said fuel tank being positioned, in its entirety, below said combustion chamber and said irradiation pipe.

9. A liquid fuel combustion type infrared ray irradiating apparatus, comprising:

a base formed in a generally parallel tetragon-shaped frame-work, each corner of which is provided with a wheel;

a heat irradiating portion having a fuel tank disposed on said base, a burner for burner fuel pumped from said tank by a pump, and an irradiation pipe for receiving combustion gas from said burner and irradiating infrared rays in the front direction; and a reinforcement member having opposite ends which are respectively fixed to rearward parts of right and left side plates of said heat irradiating portion, an intermediate portion of said reinforcement member other than the fixed ends thereof being bowed slightly backward from the fixed ends and side plates, said irradiation pipe extending generally sidewardly between said side plates and having opposite ends disposed respectively adjacent said side plates, said irradiation pipe and said reinforcement member being spaced apart in non-contacting relationship.

10. A liquid fuel combustion type infrared ray irradiating apparatus as claimed in claim 9, including a plurality of main reflecting plates, each of which is fixed for support at each end thereof to one of a pair of reflecting right and left side plates in said heat irradiating portion, said main reflecting plates being otherwise free of support, and each said main reflecting plate having a bent portion along a lower edge thereof.

11. An apparatus according to claim 9, wherein said heat irradiating portion includes a back cover upstanding from said base and interposed between said irradiation pipe and said reinforcement member, said bowed intermediate portion of said reinforcement member being spaced rearwardly from said back cover and said irradiation pipe being disposed forwardly of said back cover, said back cover including means defining a rearwardly opening elongate recess therein, and said elongate recess being positioned in forwardly adjacent and approximately parallel relationship relative to said reinforcement member to permit grasping of said reinforcement member without touching said back cover.

12. An apparatus according to claim 11, wherein said elongate recess, said reinforcement member and said irradiation pipe extend approximately parallel to each other.

* * * * *